United States Patent [19]

Klement et al.

[11] 4,303,817

[45] Dec. 1, 1981

[54] MICROWAVE OVEN

[75] Inventors: Johann Klement; Werner Schnabel, both of Traunreut, Fed. Rep. of Germany

[73] Assignee: Bosch-Siemens Hausgeräte GmbH, Stuttgart, Fed. Rep. of Germany

[21] Appl. No.: 56,073

[22] Filed: Jul. 9, 1979

[30] Foreign Application Priority Data

Jul. 12, 1978 [DE] Fed. Rep. of Germany ..... 2830658
Aug. 4, 1978 [DE] Fed. Rep. of Germany ..... 2834368

[51] Int. Cl.[3] ..... H05B 6/76
[52] U.S. Cl. ..... 219/10.55 D; 219/10.55 F
[58] Field of Search ..... 219/10.55 D, 10.55 F, 219/10.55 R; 174/35 MS

[56] References Cited

U.S. PATENT DOCUMENTS 4,053,730 10/1977 Baron et al. ..... 219/10.55 F
4,137,442 1/1979 Tateda ..... 219/10.55 F X
4,191,877 3/1980 Tanaka et al. ..... 219/10.55 E X
4,211,909 7/1980 Yoshida et al. ..... 219/10.55 F X

FOREIGN PATENT DOCUMENTS 52-47702 2/1977 Japan ..... 219/10.55 F

*Primary Examiner*—Arthur T. Grimley
*Attorney, Agent, or Firm*—Herbert L. Lerner

[57] ABSTRACT

Microwave oven having an oven muffle connected to a high frequency oscillator and a rotatable shaft brought through an opening in a metallic muffle wall with clearance. To prevent microwave energy which is brought into the cooking chamber or muffle from a high frequency generator from getting to the outside through the opening in the muffle wall, i.e. through the clearance, a microwave seal is provided comprising a metallic disc spaced a short distance from and parallel to the muffle wall to form a gap-like microwave transmission line and an annular slot-like microwave pocket adjacent the transmission line with the opening of the pocket next to the opening in the muffle wall.

18 Claims, 3 Drawing Figures

MICROWAVE OVEN

BACKGROUND OF THE INVENTION

1. Field of the Invention

The invention relates to a microwave oven having an oven muffle which can be closed off tight against microwaves and is connected to a high-frequency oscillator, a rotatable shaft which is brought through a metallic wall of the muffle, for instance of a recirculated-air blower, as well as a microwave seal provided in the area of the opening.

2. Description of the Prior Art

A microwave seal for a microwave oven in which a metallic disc is mounted on the drive shaft of a recirculated-air blower immediately outside the shaft opening in the corresponding oven wall, i.e., outside the cooking chamber is disclosed in German Published Non-Prosecuted Application No. 27 15 636. This disc is to prevent microwave energy from escaping from the cooking chamber through the shaft opening to the outside. It has been found in practice that such a simple gap is usually not sufficient to completely inhibit the escape of microwave energy, especially if the gap between the disc and the outside of the wall at the circumference of the disc is of uneven size, which is usually the case if the muffle wall is heated to a high temperature, but the disc remains relatively cool. The wall sheet has a tendency to warp because of the strong material stresses which occur due to the high temperature rise.

SUMMARY OF THE INVENTION

It is an object of the present invention to provide a microwave oven of the type mentioned at the outset with an improved and more effective microwave seal without material design alteration and increase in cost.

With the foregoing and other objects in view, there is produced in accordance with the invention a microwave oven having an oven muffle connected to a high-frequency oscillator, a rotatable shaft brought through an opening in a metallic muffle wall, a microwave seal in the area of the opening in the form of a metallic disc connected to the shaft and disposed parallel to the muffle wall at a small distance therefrom to form a gap-like microwave transmission line between the metallic disc and the muffle wall, the improvement comprising disposing an annular-slot-like microwave pocket with an opening at one end of the pocket, adjacent the gap-like microwave transmission line and with the opening of the pocket placed next to the opening in the metallic muffle wall.

Other features which are considered as characteristic for the invention are set forth in the appended claims.

Although the invention is illustrated and described herein as embodied in a microwave oven, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
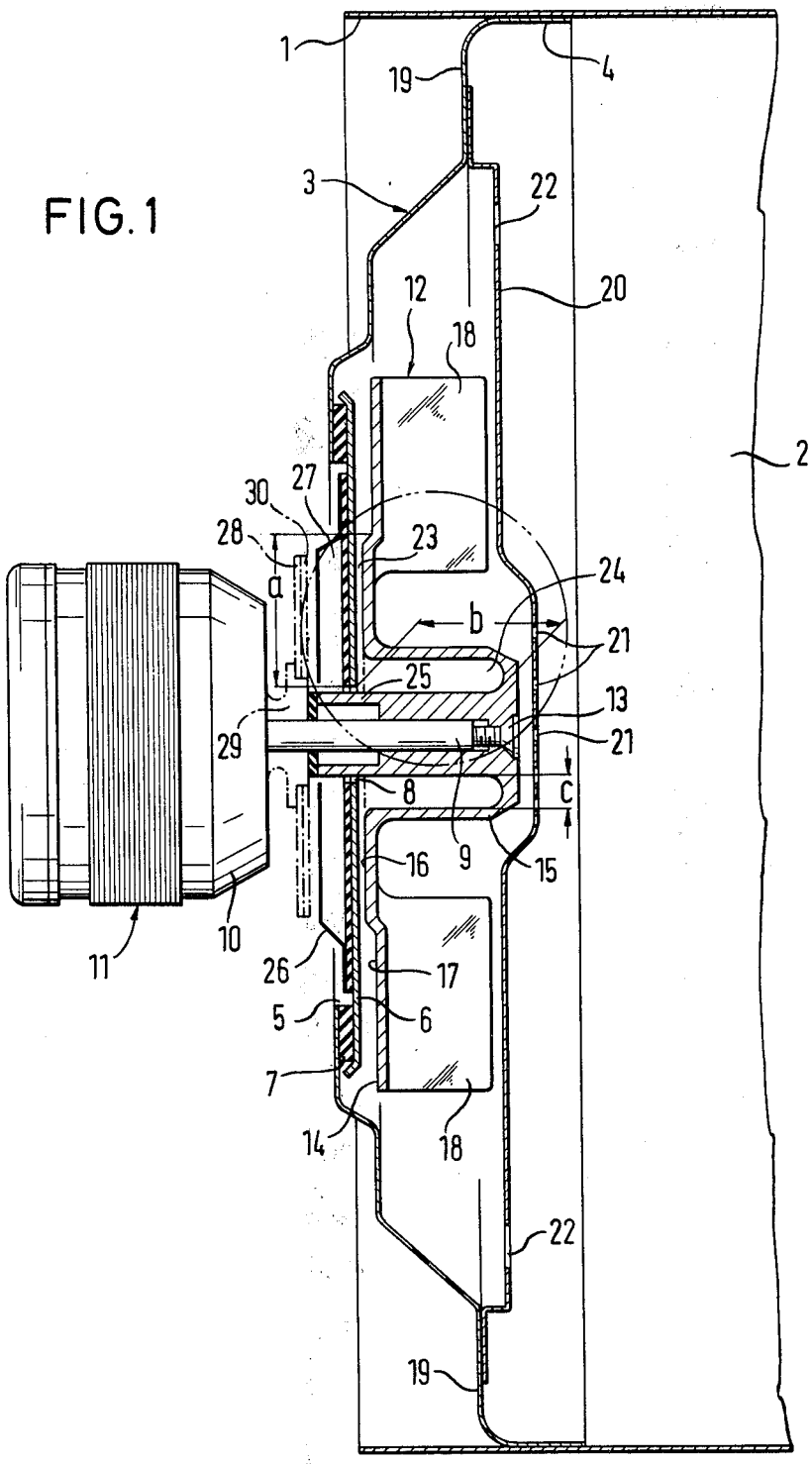
FIG. 1 schematically shows a cross-sectional view of the rear wall of the microwave oven with particular reference to the microwave seal in accordance with the invention.

A microwave pocket preferably in the form of a circular slot, which starts at the opening in the muffle wall, is disposed adjacent to the microwave transmission line formed between the disc and the muffle wall. The radial length of the microwave transmission line between the disc and the adjacent muffle wall, the length of the microwave pocket, is preferably $\frac{1}{4}$ of the wavelength of the microwaves. In this manner, a microwave trap consisting of the microwave transmission line and the microwave pocket is formed at the point at which microwave energy could escape from the interior of the muffle, namely, at the shaft opening in which the shaft is installed with clearance. Thus, an energy minimum results at this potential point of escape of microwaves.

A design-wise particularly simple means to obtain the microwave pocket, if the disc has a hub which is connected to the shaft, is to provide an annular groove in the hub with the groove substantially parallel to the axis of the shaft, and with the groove open toward the muffle wall which has the opening in the muffle wall. The microwave pocket is accommodated in the space-saving manner in the hub part of the blower wheel. Blower wheels are conventionally used exclusively for heating operations.

According to a further embodiment of the invention, the disc and the hub are fastened to that part of the shaft which protrudes into the interior of the muffle. By this means it is assured that the muffle wall and the disc are heated up to the same degree, especially in conventional or combined heating operation, so that unilateral warping of the disc or the wall, accompanied by a partial increase of the gap, does not for all practical purposed occur.

According to a preferred embodiment, the radial base plate of a recirculated-air blower wheel, to which the blower vanes are fastened and the outer hub of which contains the annular slot, serves as the disc.

An additional embodiment of a microwave seal is provided by arranging at the rotor of the external-rotor blower motor a metallic heat transport disc disposed between the former and the muffle wall or the cover plate. The metallic heat transport disc is placed at a small distance of preferably 1 to 2 mm in front of the muffle wall or the cover plate and forms a microwave-tight gap with a radial length of about $\frac{1}{4}$ of the wavelength of the microwaves. A particularly intensive effect is obtained if the heat transport disc is coated on the surface facing the muffle wall with a ferrite material, preferably ferrite rubber.

In an additional microwave seal, a metallic dish is fastened at the outside surface of the muffle wall or cover plate having the opening for the shaft, for forming a microwave pocket between the inside surface of the disc and the outer wall surface, which pocket in the form of an annular groove, is only open toward the shaft.

Another improvement of the microwave oven according to the invention is obtained by providing in the interior of the muffle, adjacent to the opening, a microwave cutoff filter consisting of a microwave slot and a microwave pocket, and also by providing outside the muffle a capacitive microwave seal in the form of a metallic disc which is mounted on the shaft and is closely adjacent to the muffle wall. It has been found that the capacitive microwave seal designed in the form of a disc rotating with the shaft, which alone is insufficient to prevent microwaves from escaping from the opening, is suitable in combination with the microwave cut-off filter arranged inside the muffle, to effectively prevent a possible residue of microwaves from radiating outside the muffle chamber.

However, a substantial improvement is alternatively provided also by a combination of the features, wherein a microwave cut-off filter consisting of microwave slot and microwave pocket is provided in the interior of the muffle adjacent to the opening, and wherein outside the muffle, adjacent to the opening, a capsule-shaped hollow body which is open toward the opening and forms a microwave pocket, is disposed.

Together with the microwave slot provided in the interior of the muffle, this capsule-shaped hollow body forms a second microwave line section with cut-off filter action, with a total length of $\frac{1}{2}$ of the wavelength of the microwaves, the microwave slot and the microwave pocket each having a length of $\frac{1}{4}$ of the wavelength of the microwaves.

The invention will be explained in the following with the aid of embodiment examples shown in the drawings.

In FIG. 1, the rear part of a microwave oven designed in accordance with the invention is shown. Numeral 1 designates the tubular muffle body which defines the interior of the muffle sideways as well as at the top and the bottom, and into which a muffle rear wall, designated generally by numeral 3, is inserted or welded. The multiply-stepped muffle rear wall 3, equipped with a fastening flange 4, has in the center a cutout 5. A metallic cover plate 6 is placed onto cutout 5 from the interior of the muffle with the interposition of an electrically conducting gasket 7, thereby closing off cutout 5. The cover plate 6 has a central opening 8, through which the drive shaft 9 of the rotor 10 of an external-rotor blower motor 11 is brought with clearance. The electric blower motor 11 is located outside the muffle. A blower wheel 12 is fastened or mounted to the end of the shaft 9 protruding into the cooking chamber 2 by means of a screw 13 or the like. The blower wheel 12 has a radial base plate 14 with a formed-on centered hub 15, the base plate 14 having an inner ring zone 16 as well as an outer ring zone 17 which is spaced from the muffle rear wall 3. At the periphery of the base plate 14 are blower vanes 18. A baffle 20 which has air intake openings 21 at the center and air discharge openings 22 near the muffle walls is placed immediately in front of the blower wheel 12. Baffle 20 is fastened to offset sections 19 of the muffle rear wall. The dash-dotted circle circumscribes a microwave seal explained below, which prevents microwave energy brought into the cooking chamber 2 by a high-frequency oscillator, not shown, via a waveguide, likewise not shown, from getting to the outside through the opening 8 in the muffle rear wall 3. For this purpose, a microwave transmission line 23 is provided which is formed by a gap between the metallic cover plate 6, which is connected to the muffle body via the gasket 7, and the inner ring zone 16 of the disc-like base plate 14 of the blower wheel 12. The spacing between the cover plate 6 and the inner disc 16 is about 1 to 1.5 mm. In the hub 15 of the blower wheel 12 there is an annular slot 24 parallel to the axis of shaft 9. Slot 24 is open toward the opening 8 and constitutes a microwave pocket. The annular slot or microwave pocket 24 and the microwave transmission line 23 form a microwave trap, the length a of the microwave transmission line 23 and the length b of the microwave pocket being equal to one-quarter of the wavelength of the microwaves; in the embodiment example, each is 32 mm. In this manner, a microwave energy minimum is created in the vicinity of the opening 8. In the embodiment example, the spacing between the disc 16 and the inside surface of the cover plate is 1 to 1.5 mm, while the width c of the microwave pocket or the annular slot 24 is about 7 mm.

In the embodiment example, the hub 15 has an extension 25 which protrudes through the opening 8 in the cover plate 6. In addition, a metallic dish 26, which serves among other things as a heat sink, is fastened to the outside of the cover plate 6 in such manner that it is in electrically conducting connection with the cover plate 6 and thereby, with the muffle. This dish 26 forms a microwave pocket 27 in the form of a circular slot, open only toward the shaft 9, of length a. Microwave pocket 27 contributes, in addition to the microwave pocket 24 or in lieu thereof, to the improvement of the microwave seal. The dash-dotted lines indicate that a metallic heat transport disc 28, located between the blower motor and the cover plate 6, can be fastened to the rotor 10 of the external-rotor blower motor 11 via a connecting hub 29. Disc 28 is arranged at a small distance of preferably 1 to 1.5 mm in front of the outside surface of the dish 26 and forms a microwave-tight gap with a radial length of $\frac{1}{4}$ of the wavelength of the microwaves. The sealing effectiveness can be increased further by coating the heat transport disc 28 on the surface facing the muffle wall with a ferrite material 30, preferably with ferrite rubber.

The presence of the described microwave trap in the vicinity of the opening 8 provides the means of separating the blower space, in which the blower wheel 12 is located, from the rest of the interior of the muffle 2 by a normal baffle 20 such as used in conventional recirculated-air baking ovens, with relatively large discharge openings 22, without having to take precautions that the baffle is microwave-tight. The blower unit described can furthermore be used universally, i.e., can also be used in baking ovens with conventional electric heating, where the heat transport disc 28 can serve to remove the operating heat of the blower motor 11, and the dish 26 can serve as a heat sink element.

Figure 2:
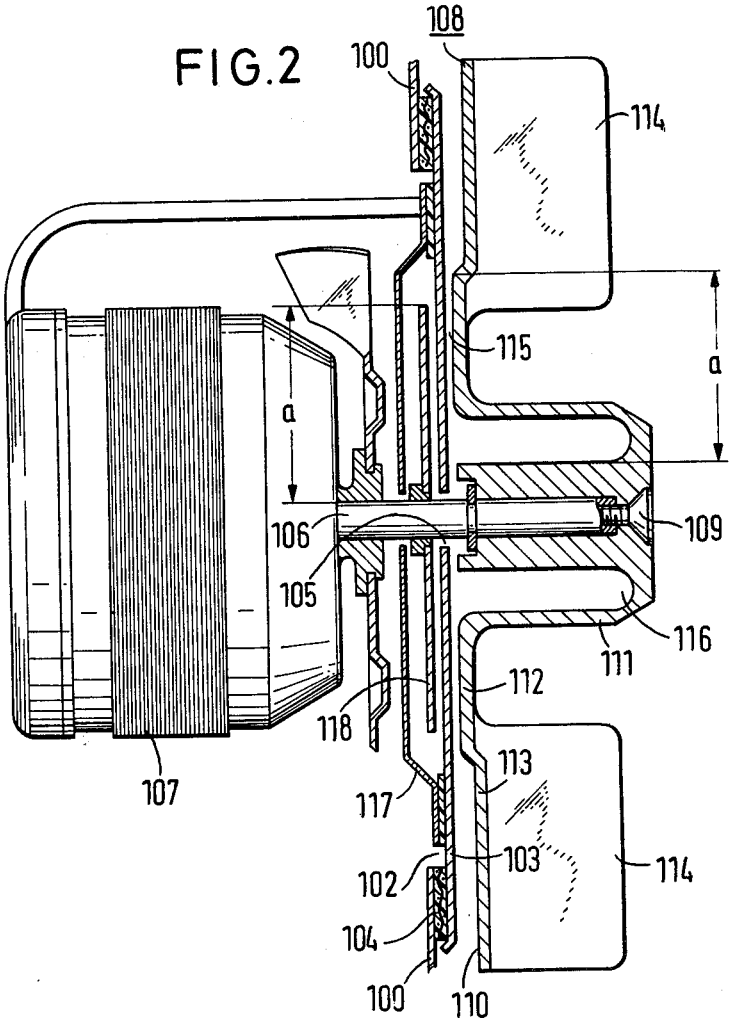
FIG. 2 is a cross-sectional view of part of the microwave oven according to the invention, illustrating a second embodiment of the microwave seal.
Figure 3:
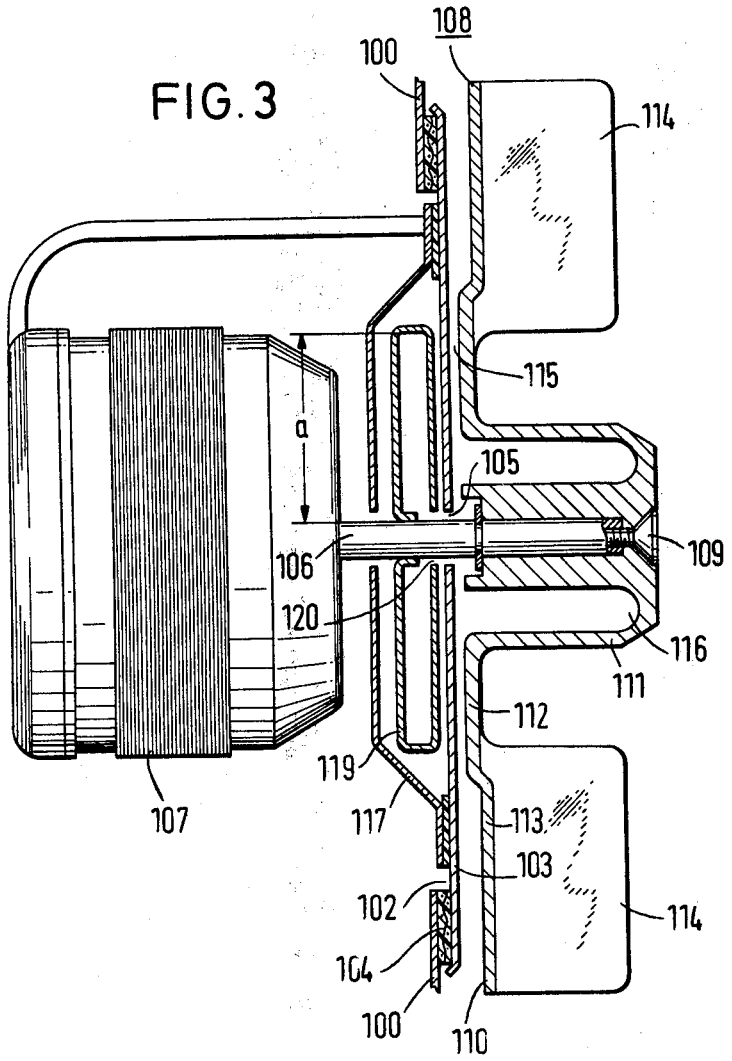
FIG. 3 is a cross-sectional view of part of the microwave oven according to the invention, illustrating a third embodiment of the microwave seal.

In the embodiment examples according to FIGS. 2 and 3, the respective rear part of a microwave oven is shown. The muffle rear wall of a muffle which is accessible through a charging opening on the front side but is not otherwise shown, is designated by numeral 100. In the center, the muffle rear wall 100 has a cutout 102 onto which a metallic cover plate 103 is placed from the interior of the muffle, and thereby closes off cutout 102.

The cover plate 103 is in metallic contact with the muffle rear wall 100, for instance, by providing that the sealing strips 104 have dispersed a metal fabric, and thus the cover plate 103 becomes in effect the muffle rear wall for that part of the cutout it covers. The cover plate 103 has a central opening 105, through which the drive shaft 106 of an external rotor blower motor 107 is brought with radial clearance. The electric blower motor 107 is located outside the muffle. A blower wheel 108 is fastened or mounted by means of a screw 109 or the like to the end of the shaft 106 extending into the cooking chamber. The blower wheel 108 has a radial base plate 110 with a formed-on centered hub 111, the base plate 110 having an inner ring zone 112 as well as an outer ring zone 113 spaced from the muffle wall. The blower vanes 114 are located at the periphery of the base plate 110. Immediately in front of the blower wheel 108 is fastened a conventional baffle, not shown, which has air intake openings in the center and air discharge openings in the vicinity of the muffle walls. The arrangement shown contains means to prevent the microwave energy which is brought into the cooking chamber from a high-frequency generator, not shown, via a waveguide, likewise not shown, from getting to the outside through the opening 105 in the muffle rear wall. To this end, a microwave cut-off filter is provided consisting of a microwave slot 115 between the muffle rear wall 100 or the cover plate 103 and the inner ring zone 112 of the disc-like base plate 110 as well as of a microwave pocket 116 formed by an annular slot in the hub 111 of the blower wheel 108. The slot of pocket 116 is parallel to the axis of the drive shaft 106 and is open toward the opening 105. Here, the length a of the microwave slot 115 and the microwave pocket 116 is equal to $\frac{1}{4}$ wavelength of the microwaves, i.e., to a total of $\frac{1}{2}$ wavelength. The opening 105 is at that point within the microwave cut-off filter where the standing wave developing in the microwave pocket by reflection has an energy minimum (current zero crossing). Otherwise, a dish-shaped protective plate 117 which is in metallic contact with the cover plate 103 or the muffle rear wall 100, is placed in both embodiment examples on the outside of the cover plate 103.

In the embodiment example according to FIG. 2, a capacitive microwave seal is provided on the outside of the muffle rear wall 100 or the cover plate 100, in the form of a metallic disc 118. Disc 118 is fastened on the shaft 106 and is closely adjacent to the cover plate 103, and has a radial length a corresponding to $\frac{1}{4}$ of the wavelength of the microwaves. The disc 118 has a preferred clearance of 1.5 mm from the cover plate 103.

Contrary to the embodiment example according to FIG. 2, a capsule-shaped hollow body 119 which is open toward the opening 105 at the point 120, is supported by and fixed to shaft 106, in the embodiment example according to FIG. 3, instead of the disc 118. The hollow body 119 has a radial inside length a of $\frac{1}{4}$ of the wavelength of the microwaves and constitutes an additional microwave pocket which together with the microwave slot 115 forms a microwave cut-off filter. The metallic cavity 119 can be arranged so closely to the cover plate 103 that in addition, a capacitive microwave seal similar to FIG. 2 is obtained.

There are claimed:

1. Microwave oven, comprising an oven muffle connected to a high-frequency oscillator, a metallic muffle wall having an opening formed therein, a rotatable shaft extended through the opening in the metallic muffle wall, a microwave seal in the area of the opening in the form of a metallic disc connected to the shaft and disposed parallel to the muffle wall at a small distance therefrom forming a gap-like microwave transmission line between the metallic disc and the muffle wall, said metallic disc having an annular-slot-like microwave pocket formed therein with another opening at one end of the pocket being disposed adjacent the gap-like microwave transmission line and adjacent the opening in the metallic muffle wall.

2. Microwave oven according to claim 1, wherein the disc has a hub connected to the shaft, said hub having an annular slot formed therein substantially parallel to the axis of the shaft said slot being open toward the muffle wall having the opening formed therein, forming the microwave pocket.

3. Microwave oven according to claim 1, wherein the radial length of the microwave transmission line between the disc and the adjacent metallic muffle wall and the length of the microwave pocket each is about $\frac{1}{4}$ of the wavelength of the microwaves.

4. Microwave oven according to claim 2, wherein the radial length of the microwave transmission line between the disc and the adjacent metallic muffle wall and the length of the microwave pocket each is about $\frac{1}{4}$ of the wavelength of the microwaves.

5. Microwave oven according to claim 1 or claim 2 or claim 3 or claim 4, wherein the distance between the disc and the muffle wall is 1 to 2 mm and the inside width of the microwave pocket is about 7 mm.

6. Microwave oven according to claim 2, wherein the disc and the hub are fastened to the shaft part protruding into the interior of the muffle.

7. Microwave oven according to claim 2, wherein the hub has an extension protruding through the opening in the muffle wall.

8. Microwave oven according to claim 2, wherein said disc is a radial base plate of a recirculated-air blower wheel, and including blower vanes fastened to said plate, said plate being extended from the hub the annular slot formed therein.

9. Microwave oven according to claim 8, wherein the base plate has an inner ring zone forming the disc and an outer ring zone spaced from the muffle wall.

10. Microwave oven according to claim 8, including a blower motor of a recirculated-air blower disposed on the outside of the muffle wall, the muffle wall being vertical and having a cutout formed therein which corresponds to at least the size of the blower motor, a metallic cover plate closing off said cutout with the interposition of an electrically conducting gasket, which coverplate has an opening for said rotatable shaft formed therein, said recirculated-air blower wheel being disposed close to the cover plate, and a baffle covering said blower wheel toward the interior of the muffle, the baffle having large-area air-discharge openings formed therein.

11. Microwave oven according to claim 10, wherein a metallic heat transport disc is fastened to the rotor of said external-rotor blower motor with said transport disc located between the former and the muffle wall, said heat transport disc is disposed with a small spacing of about 1 to 2 mm in front of the outer muffle boundary, and forms a microwave-tight gap with a radial length of about $\frac{1}{4}$ of the wavelength of the microwaves.

12. Microwave oven according to claim 11, wherein the heat transport disc is coated on the surface facing the muffle wall with a ferrite material.

13. Microwave oven according to claim 2, wherein a metallic dish is fastened at the outside surface of the muffle wall having the opening, to form a microwave pocket in the form of an annular slot open toward the shaft, between the inside surface of the disc and the outside surface of the muffle wall.

14. Microwave oven according to claim 13, wherein a capacitive microwave seal in the form of a metallic disc is fastened on the shaft and is disposed outside the muffle, closely adjacent to the muffle wall.

15. Microwave oven according to claim 2, wherein a capsule-like hollow body is disposed on the shaft outside the muffle, adjacent to the opening in the muffle of the wall which body is open toward the opening and forms a microwave pocket.

16. Microwave oven according to claim 14, including a dish-shaped protective plate which is placed on the muffle wall defining a cavity therebetween in which said disc is disposed.

17. Microwave oven according to claim 15, including a dish-shaped protective plate which is placed on the muffle wall defining a cavity therebetween in which said hollow body is disposed.

18. Microwave oven according to claim 9, including a wall-parallel base plate of a recirculated-air blower, said base plate and the muffle wall defining a microwave slot therebetween having a radial length of $\frac{1}{4}$ of the wavelength of the microwaves.

* * * * *